US008485456B2

(12) United States Patent
Gryaznov et al.

(10) Patent No.: US 8,485,456 B2
(45) Date of Patent: Jul. 16, 2013

(54) METHOD AND APPARATUS FOR MANUFACTURING SUBMICRON POLYMER POWDER

(75) Inventors: Igor Gryaznov, Dnipropetrovsk (UA); Stanislav Gryaznov, Haifa (IL); Ann Gryaznova, Petach-Tikva (IL); Oleg Figovsky, Haifa (IL)

(73) Assignees: Nanotech Industries, Inc., Daly City, CA (US); Polymate, Ltd., Migdal Ha'Emeg (IL)

( * ) Notice: Subject to any disclaimer, the term of this patent is extended or adjusted under 35 U.S.C. 154(b) by 385 days.

(21) Appl. No.: 12/981,202

(22) Filed: Dec. 29, 2010

(65) Prior Publication Data

US 2012/0168541 A1 Jul. 5, 2012

(51) Int. Cl.
*B02C 19/18* (2006.01)

(52) U.S. Cl.
USPC ..... 241/1; 241/19; 241/23; 241/29; 241/65; 241/79.1; 241/152.2; 241/301

(58) Field of Classification Search
USPC ..... 241/1, 23, 29, 65, 152.2, 301, 79.1
See application file for complete search history.

(56) References Cited

U.S. PATENT DOCUMENTS 7,482,393 B2 1/2009 Cody et al.

FOREIGN PATENT DOCUMENTS

| | | |
|---|---|---|
| DE | 2 315 942 | 10/1973 |
| RU | 2 035 308 C1 | 5/1995 |
| RU | 2 133 196 C1 | 7/1999 |
| RU | 2000117474/03 | 5/2000 |
| WO | 98/47621 A2 | 10/1998 |

*Primary Examiner* — Mark Rosenbaum
(74) *Attorney, Agent, or Firm* — TransPacific Law Group; Pavel I. Pogodin, Esq.

(57) ABSTRACT

A method and apparatus for manufacturing a submicron polymer powder from solid polymer bodies or coarse particles, preferably of polytetrafluoroethylene powder, wherein powder is ground into fibrous particles in the first stage and is disintegrated into submicron particles by aerodynamic treatment in the second stage, where a gas-particle mixture is subject to the effect of centrifugal forces and suction forces acting in the direction opposite to the centrifugal forces, a pulsating sign-alternating temperature field generated by a pulsed supply of liquid nitrogen, turbulent forces of vortexes, and aerodynamic forces that cause alternating compression and expansion of the gas-particle mixture.

20 Claims, 6 Drawing Sheets

METHOD AND APPARATUS FOR MANUFACTURING SUBMICRON POLYMER POWDER

FIELD OF INVENTION

The present invention relates, in general, to production of polymer powders and, in particular, to an energy-saving apparatus and method for manufacturing submicron polyolefin powders such as polytetrafluoroethylene (PTFE). The invention may find use in operations associated with reprocessing solid blocks of polyolefins, such as PTFE, into submicron-type PTFE. The method and apparatus of the invention may also be used to increase the degree of disintegration of standard polyolefin powders. PTFE powders produced by the method and apparatus of the invention may also be used in the manufacture of lubricating materials, composite materials, finely dispersed polyolefin suspensions, and finely granulated polyolefins.

BACKGROUND OF THE INVENTION

In terms of quantities, the volume of annual production of fluoropolymers is not significant and is approximately one hundred thousand tones, which constitutes less than 0.1% of the world production of all polymers. However, in terms of cost, this segment of the market is significant, as it constitutes more than $2.5 billion and is steadily growing. In the production of fluoropolymer, the main share falls on PTFE (60 to 80%). The cost of fluoropolymers varies greatly. If for PTFE powders the cost per kilo ranges from tens of dollars, the cost per kilo for Nafion®-type films is as high as $50,000.

One tendency in the fluoropolymer market is the steady growth of high-tech products. Another tendency is the emergence of new fluoropolymer manufacturers, in particular, in China. These new producers are leading others in production volumes and are rapidly gaining popularity because of the low cost of their products.

On the other hand, a considerable volume of PTFE waste that sometimes reaches 40% of the production volume accumulates in the surrounding environment. Some specific features of polymer waste is stability against aggressive media, long periods of decomposition under natural conditions, and lack of decay. Most problematic in this respect are fluoroplastics, in particular, PTFEs, which, in fact, are valuable materials.

Production of PTFE micropowders in the USA, Russia, Western Europe, Japan, and China is measured in thousands of tons. For example, DuPont de Neumours & Company (USA) produces ultrafine powders of PTFE under the brand name Zonyl Fluoroadditive 1100 and Teflon® MP; DuPont Krytox (USA) produces granulated powders Teflon® PTFE; Lubrizol Corporation (USA) produces Fluotron dispersions; Western Reserve Chemical Corporation (USA) produces Powder PTFE Plastolon P-550; Shamrock Technologies, Inc. (USA) produces powders of Fluoro™ PTFE micronized series (average particle size of 1 to 2 μm); Russian companies Forum and Tomflon produce PTFE colloidal dispersions of the NanoFlon series and PTFE micropowders; and Dongyue Polymer Material Co., Ltd. (China) produces ultrafine PTFT powders having particle sizes that vary from 10 to 400 nm.

Main methods for industrial production of PTFE powders are based on polymerization of gaseous PTFE in aqueous media at predetermined technical conditions and with addition of appropriate reaction initiators. Particles obtained by such methods have dimensions ranging from 50 to 500 μm. By treating the powders in jet mills, particle diameter can be reduced from 50 to 10 μm.

Some methods of manufacturing PTFE powders involve radiation treatment of PTFE waste. Radiation causes accumulation of defects that initiate development of microcracks in the polymer. When the irradiated material is treated in jet mills, the particles break along these microcracks. The resulting particles have a molecular structure that completely corresponds to the structure of industrial samples of PTFE. For example, U.S. Pat. No. 7,482,393 issued in 2009 to C. Cody, et al, discloses a method for producing a submicron polytetrafluoroethylene (PTFE) powder in a free-flowing, readily dispersible form. The irradiated PTFE starting material is placed in a desired solvent and undergoes grinding until the PTFE particles reach submicron size. The submicron particles are subsequently recovered from the solvent and dried to form a powder that may have particles less than 1.00 μm in size. The dry PTFE powder may then be readily dispersed to submicron size into the desired application system. The submicron PTFE powder of this method is free flowing, readily dispersible in various application systems, and tends not to "dust" or self-agglomerate. Improved aqueous and organic dispersions of submicron PTFE particles may display increased stability and may require much less agitation than dispersions obtained by other processes. Such improved PTFE dispersions may be formed with or without the addition of surfactants, wetting agents, rheology modifiers, pH-adjusting agents, and the like.

German Patent No. 2315942 published in 1973 (inventor, Reinhard Neumann) discloses a method of manufacturing a granulated PTFE powder by mixing the PTFE powder disintegrated to particle size in the range of 0.1 to 0.5 mm with a liquid that is inert and nonwetting with respect to the PTFE and then drying the obtained granules at a temperature below the boiling point of the liquid. The initial material of the process comprises a polymer mixture obtained by suspension or emulsion polymerization. The particles are subjected to forces that occur during mixing.

Russian Patent RU 2133196 issued in 1999 (inventors, A. Uminskij, et al) discloses a method and apparatus according to which the apparatus is preliminarily flushed through with dry nitrogen and then filled with equal portions of a fluoroplastic waste. Batch melt is heated in a reactor, and hot fluoroplastic destruction products are cooled by a gas carrier and displaced into a tube. Products are deposited on walls and in a cooler and are then collected in receivers in the form of a powder, which is then packed. Remaining destruction material having been separated from the powder product is loaded into an afterburner, from which the resulting product is discharged through a discharge port for further processing.

An installation for recovering PTFE is described in Russian Patent RU2035308 (published in 1995; inventor, A. K. Tsvetnikov). The installation contains a reactor, a furnace, a screw-type feeder, cooling systems, and a fan. The reactor is provided with a cylindrical insert having a perforated bottom. The walls of the cylindrical insert are spaced from the inner walls of the reactor. The upper edge of the insert is arranged at the same level or below the level of the outlet openings of the reactor for discharge of the destruction products. Heating of the melt in the reactor to a temperature of 490 to 510° C. leads to thermal destruction, while the provision of a gap between the insert and the reactor walls makes it possible for the fan to blow the thermal-destruction products through a liquid-reaction phase. This increases gas-flow volume. The yield of the finely dispersed PTFE reaches 75%.

Russian Patent Application Publication 2000117474/03 published in 2002 (inventors, V. V. Panamarchuk and V. P. Deliya) discloses a method and a device for finely disintegrating powder materials. The method comprises acceleration of treated particles and simultaneously subjecting the particles to the effect of fields of centrifugal and pulsating-aerodynamic forces, wherein the aforementioned fields are generated without the use of external initiators. The aerodynamic field is created under the action of pumping blades and grinding rods at rotor rotation frequency in the range of 1500 to 3000 rpm. The field of aerodynamic forces has two turbulent counter-flows, and the zone of collision of two flows is additionally intersected by the openings of the centrifugal disk.

The apparatus for carrying out the above-described method comprises a disintegrating chamber formed by a vertically arranged housing and a vertically arranged rotor rotationally installed in the housing. The rotor is made in the form of a beam that is provided with vertically oriented stirring rods. The rotor comprises a drive shaft that rigidly supports the pumping blades and a centrifugal disk, which is provided with disintegrating rods. The pumping blades are located above the centrifugal disk and are inclined at an angle adjustable from 0 to 20°. A disadvantage of this device is insufficient degree of dispersion in the obtained product.

An apparatus for reprocessing PTFE is described in International Patent Application Publication WO 9847621 (A2) (1998, inventor A. F. Eryomin). The apparatus comprises a vortex rotary device that includes a housing containing a coaxially arranged rotor. The rotor has slots on its side surface and inlet and outlet pipe units for input and output of the treated material and a processing gas. The inner surface of the housing and the outer surface of the rotor are conical and equidistant. The side surface of the rotor has at least one annular rib that forms disintegrating chambers that communicate with each other.

In operation, the powder to be treated and the carrier gas are fed into the housing of the device through the respective pipe unions. In the course of rotation of the rotor, the slots of the rotor cause generation of intensive vortexes of the gas in the gap between the rotor and the inner walls of the housing. When the powder passes through the sequentially arranged disintegrating chambers, the powder particles collide with each other and disintegrate. The tapered shape of the rotor and the chamber provides intensification of the process in the direction from inlet to outlet.

SUMMARY OF THE INVENTION

The invention provides a method and apparatus for reprocessing solid bodies of polymer powders or coarse polymer powders into submicron particles. In particular, the invention relates to manufacturing submicron powders of PFTE.

According to the method of the invention, the charge of solid polymer bodies or coarse particles is loaded into a feeder and brought under pressure into contact with the tapered surface of the rotating abrasive disk for grinding into fibrous polymer particles or particle agglomerates. The ground particles together with a gaseous carrier, e.g., air, then enter an aerodynamic disintegration zone that is formed between the hollow cylindrical cage and the aerodynamic rotor located inside the cylindrical cage. The cylindrical cage and aerodynamic rotor rotate in opposite directions with appropriate rotation speeds, and the fibrous polymer particles enter the spaces between the blades secured in the aerodynamic rotor and the particle-disintegrating elements secured in the hollow cage, as well as between the particle-disintegrating elements and the inward radial projections of the housing. The interaction of the gas-particle mixture with the aforementioned blades, projections, and particle-disintegrating elements generates areas of intense turbulence or vortexes. When the fibrous PTFE particles and agglomerates thereof sequentially pass through the vortexes of aerodynamic disintegration, they are heated because of collision with the obstacles and with each other and then they disintegrate.

Thus, when during the above-described process the abrasive rotor and the aerodynamic rotor rotate in mutually opposite directions with appropriate rotation speeds and the fibrous PTFE particles enter the spaces between the blades and the particle-disintegrating elements, as well as between the particle-disintegrating elements and the inward radial projections of the housing, the interaction of the gas-particle mixture with the aforementioned blades, projections, and the particle-disintegrating elements generates areas of intense turbulence or vortexes. When the fibrous PTFE particles and agglomerates thereof sequentially pass through the vortexes of aerodynamic disintegration, they are heated and then disintegrate.

The heated particles are cooled in the temperature-alternating mode by pulsed supply of liquid nitrogen into the zone of aerodynamic disintegration. When liquid nitrogen sharply converts from a liquid state to a gaseous state, it instantly expands, and this leads to cooling of the gas-particle mixture.

The zone of aerodynamic disintegration is connected to a submicron-particle separation unit that comprises an aspiration system and a series of cyclone-type separators where particles separate from the gas flow and collect for unloading to a receiving container. The aspiration system suctions air from the environment, and the suctioned air is used as a carrier gas for subsequent mixture with polymer particles.

In the aerodynamic disintegration zone the particles rotate together with the aerodynamic rotor. Those particles that have a greater mass are thrown by centrifugal forces in the outward radial direction, and the process of their disintegration is continued. The central area of the aerodynamic disintegration zone is connected to a vacuum system. The particles of smaller size, e.g., of submicron size, develop a lower centrifugal force than the large-mass particles, and therefore cannot overcome the central force of vacuum attraction. As a result, a classification process occurs according to which high-mass particles enter the periphery of the aerodynamic disintegration zone, while smaller particles, e.g., submicron particles, are suctioned into the central channel and are unloaded from the system as a final product.

DETAILED DESCRIPTION OF THE INVENTION

Figure 1:
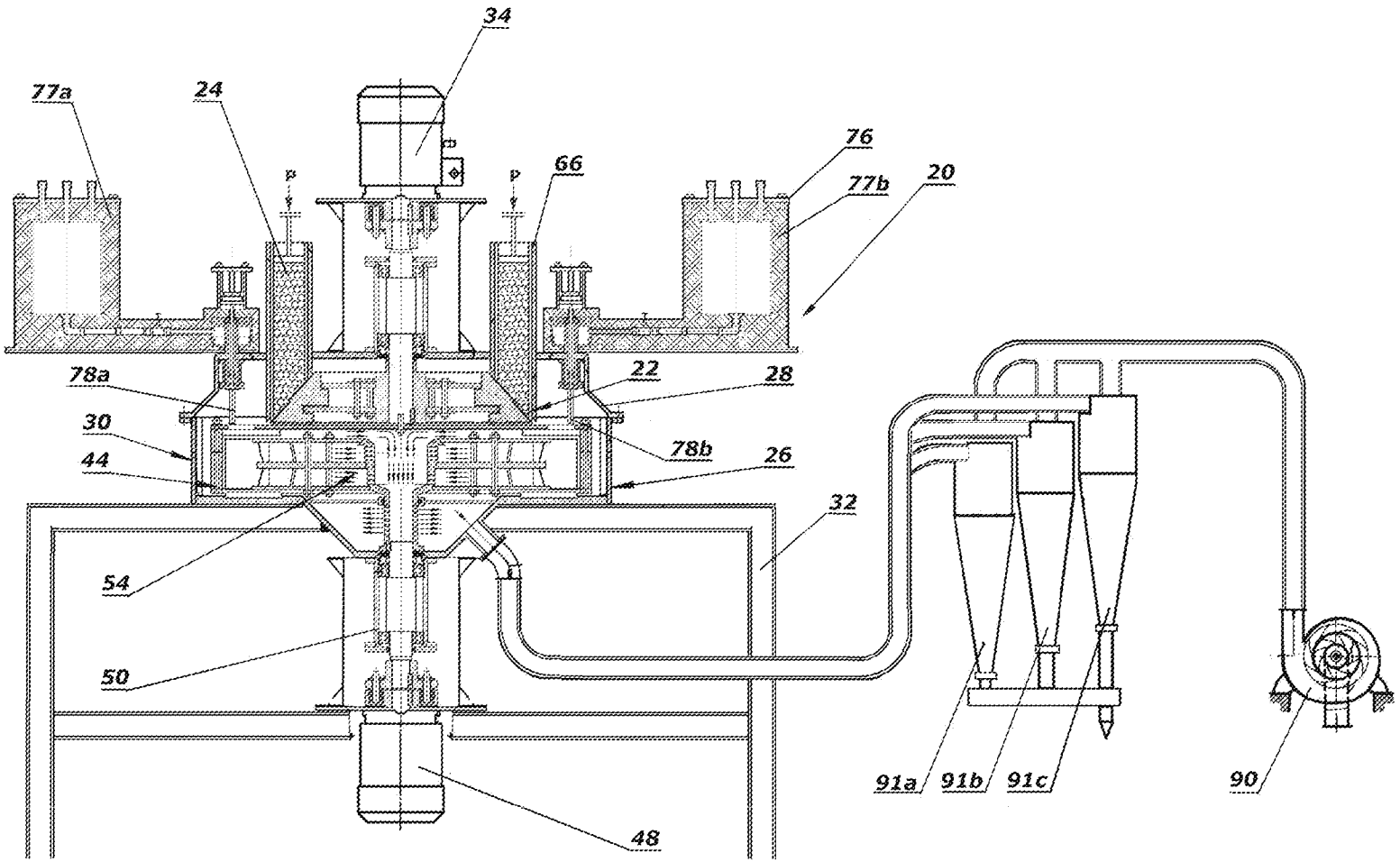
FIG. 1 is a vertical sectional view of the apparatus according to some embodiments.

The invention relates to a method and apparatus for reprocessing solid PTFE waste into submicron PTFE powder with improved physical, mechanical, and tribological properties. In general, the method according to some embodiments is based on abrasive disintegration of solid PTFE, and supply and removal of a gaseous carrier into and from the working chamber of the processing apparatus. In some embodiments, the collision and turbulent aerodynamic dispersion of fibrous PTFE particles may be obtained as a result of the aforementioned disintegration, and the optimization of aerodynamic forces in two turbulent counterflows, and generation of alternating compressions and expansions of the gaseous medium along with an alternating temperature field. Some embodiments may provide the following operating conditions:

- Decrease in molecular weight of processed PTFE and respective change in physical and mechanical properties of PTFE caused by abrasive wear;
- Obtaining, in the process of abrasive grinding, fibrous PTFE particles and their agglomerates which are close in their dimensions to telomeres of tetrafluoroethylene;
- Aerodynamic heating of the fibrous particles along with the gaseous carrier;
- Turbulent aerodynamic disintegration of heated fibrous particles under the effect of pulse aerodynamic forces in two turbulent counterflows;
- Stimulation of relaxation of intramolecular and intermolecular stresses with resulting decrease of polarization of PTFE particles that provides optimization of the shapes of the obtained submicron PTFE particles under sign-alternating temperature conditions in a gaseous carrier; and
- Separation of the obtained submicron PTFE particles by masses and unloading thereof under conditions of simultaneous action of centrifugal forces toward the periphery and suction toward the center.

The above conditions are achieved by the method and apparatus of the invention and improve efficiency in refining PTFE while at the same time reducing energy consumption.

According to some embodiments of the method disclosed herein, disintegration of PTFE powder may be carried out in two stages, as described below.

First Stage of Disintegration Process

Molecular mass and degree of polymer crystallization affect thermal characteristics of polymers providing their softening and fusion, as well as hardness and strength. Polymers consisting of large macromolecules that form crystalline permolecular structures such as PTFE, are characterized by the highest thermal, physical, and mechanical values. Therefore, destruction of permolecular and molecular structures of these polymers requires application of significant amounts of energy. Change in molecular mass and degree of crystallization of a polymer leads to changes in thermal, physical, and mechanical properties of the polymer.

According to embodiments disclosed herein, solid block or coarse particles of PTFE are reprocessed into smaller fibrous particles and particle agglomerates by means of abrasive treatment. The abrasive treatment destroys permolecular structures and thus reduces molecular mass and changes physical, mechanical, and thermal properties of PTFE. This facilitates further disintegration of the PTFE particles.

In low-molecular-mass phases of a polymer, processes begin at lower temperatures. On the other hand, the degree of crystallinity of PTFE to a much greater extent depends on thermal prehistory: in nonsintered samples the degree of crystallinity is as high as 90%, while in sintered samples it ranges from 40 to 70% and depends on reprocessing conditions, mainly the speed of cooling. As the degree of crystallinity increases, the mechanical properties of PTFE deteriorate.

Synthesis of low-molecular-weight fluoropolymers can be realized by telomerization (i.e., by polymerization that occurs in the presence of chain transfer agents to yield a series of products of low molecular weight). As a result, a mixture of homological low-molecular-weight TFPE compounds (telomers) having a degree of polymerization in the range of 10 to 20, is formed. Heating of TFE samples of telomers to a temperature of 180 to 200° C. softens the fluoropolymer and causes spreading thereof over the substrate surface. As a result, a continuous fluoropolymer film having a thickness of 1 to 5 μm and a structure close to that of PTFE is formed.

The molecular mass of PTFE depends on the method of manufacturing and, according to various sources, varies from 300,000 to 3,000,000 or higher. For the length of the —C—C— bond in an elementary link $—[—CF_2—CF_2—]_n$ equal to $0.154\times10^{-9}$ m and molecular mass of the elementary link equal to $0.924\times10^{-3}$ m, the length of a macromolecule may range from $0.924\times10^{-4}$ to $0.924\times10^{-3}$ m.

Proven experimentally was the possibility of obtaining powdered PTFE from solid PTFE blocks by abrasive treatment of the blocks (the size of the obtained PTFE particles ranged from $0.2\times10^{-4}$ to $0.6\times10^{-4}$ m). The treatment was carried out with the use of a diamond abrasive tool that provided maximum process efficiency without heating of PTFE at a linear speed of the abrasive tool from 30 to 40 m/sec. The linear speed of the abrasive tool was the main factor that determined particle size. Thus, abrasive wear destroys PTFE molecules, reduces the molecular mass of the PTFE particles, and decreases the softening and melting points of PTFE.

In accordance with some embodiments, the process of abrasive wear of the PTFE blocks is carried out with use of an abrasive rotor having an abrasive tool with hard crystals on its surface. The dimensions of these hard crystals may be comparable with dimensions of the carbon-carbon bonds of PTFE molecules. In order to improve efficiency of grinding, the linear speed on the surface of the abrasive tool may be higher than 30 m/sec. The solid PTFE blocks are fed at an angle of 45° to the plane of rotation of the abrasive surface. The force of pressure of the PTFE blocks on the abrasive surface is maintained constant during the entire grinding process.

Fibrous particles obtained at the stage of abrasive treatment are transferred from the zone of abrasive treatment to the zone of aerodynamic treatment for further refining at the second stage of disintegration. In order to improve transfer efficiency of the fibrous particles from the zone of abrasive treatment to the zone of aerodynamic disintegration, the abrasive surface is profiled so that the height of the profiled areas is substantially equal to the thickness of the metallic bond used to bond hard crystals and so that the angle of inclinations of the profiled parts to the plane of rotation does not exceed 45°.

Second Stage of Disintegration Process

At the second stage, the obtained fibrous particles and PTFE agglomerates are sent, using a gaseous carrier, to an aerodynamic block where they are subjected to the following treatments:

- Aerodynamic heating;
- Turbulent aerodynamic disintegration under the effect of aerodynamic forces of two turbulent counterflows pulsating with frequency of greater than 20000 Hz to obtain submicron particles, the counterflows being generated by rotation of a hollow cylindrical cage and aerodynamic rotors in opposite directions, both rotating bodies being provided with particle-disintegrating elements;

Optimization of particle shape, stimulation of particle relaxation, and decrease of particle polarization by subjecting particles to the effect of a pulsating sign-alternating temperature field;

Classification of submicron particles by mass; and

Removing particles from the aerodynamic block under the effect of centrifugal forces and suction toward the center of the aerodynamic block.

It should be noted that the particles obtained at the stage of abrasive treatment of the block-type PTFE may have an irregular, fibrous, torn, or ragged configuration and dipole polarization. Such conditions may create problems for use during subsequent treatment. According to the invention, these problems may be mitigated by subjecting the PTFE particles to the effect of a sign-alternating temperature field. More specifically, at the aerodynamic stage of the process, the gas-particle mixture is subjected to cyclic heating and cooling in a range of temperatures including a low temperature value and a high temperature value. In some embodiments, the high temperature value may be the melting point of the low-molecular phase of the PTFE particles. The low temperature value may be the boiling point of liquid nitrogen that was supplied to the mixture at the stage of disintegration of the solid-phase PTFE. Thus, the particles are softened and depolarized, whereby they acquire a more optimized and smoothened shape, which is close to spherical.

Heating of the fibrous PTFE particles that leads to an increase in thermal-motion energy. Particle softening results from aerodynamic heating of the gaseous carrier caused by boundary-layer friction of the gaseous carrier on the surface of rotating bodies of the apparatus, as well as by friction between the gas molecules and the particles. From the areas where gas has an elevated temperature, heat is transferred to the moving PTFE particles, whereby they are aerodynamically heated.

The maximum temperature to which gas can be heated in the vicinity of a moving body is close to the so-called temperature of braking $T_0$:

$$T_0=T_H+v^2/2c_p \quad (1)$$

where:

$T_H$ is temperature of inflowing gas

V is velocity of moving body $c_p$ is specific heat of gas at constant pressure

Since maximum input of energy into the gas-particle mixture occurs in the area of aerodynamic disintegration, aerodynamic heating of the gas-particle mixture occurs particularly in this area. In view of the small size of PTFE particles, their aerodynamic heating and softening occurs during small fractions of a second.

As the velocity of the moving body grows, the temperature of air behind the impact wave and in the boundary layer increases. The degree of aerodynamic heating may depend on the shape of the body, which is taken into consideration by introducing a coefficient of aerodynamic resistance $C_x$. The two types of aerodynamic heating are convection and radiation. Convection heating is the transfer of heat from the area of the boundary layer to the surface of the moving object through heat conductivity and diffusion. Radiation heating is transfer of heat due to radiation from gas molecules. The relationship between heat convection and radiation depends on the velocity of the moving object. Convection heating prevails until circular orbital velocity is reached.

Quantitatively, convection heat flow is determined from the following equation:

$$qk=a(T_e-T_w) \quad (2)$$

where:

$T_e$ is equilibrium temperature (the limit temperature to which the surface of the body can be heated in the absence of energy removal);

$T_w$ is the real temperature of the surface;

"a" is the coefficient of convection heat exchange that depends on movement velocity, body shape and dimensions, and so forth.

Equilibrium temperature is close to braking temperature, To (cf. Eq. (1)). Dependence of coefficient "a" (cf. Eq. (2)) is determined by the laminar or turbulent condition of the flow in the boundary layer. For turbulent flow, convection heating becomes more intensive because in addition to molecular heat conductance, an essential role in transfer of energy belongs to turbulent pulsations of velocity in the boundary layer.

Investigation of thermal behavior of submicron PTFE showed that in contrast to conventional powdered PTFE, which, as known, is thermally stable (melting point of 327° C.; decomposition temperature of 425° C.), a decrease in weight of the ultrafine PTFE begins at 50° C.

It is known that the melting point and the starting temperature of the decrease in polymer molecular mass depend on the molecular mass of macromolecules. In low-molecular phases these processes begin at relatively lower temperatures. At temperatures up to 150 to 200° C., macromolecules that are formed from fragments of $CF_2$— comprise mainly spiral chains of different length which are predominantly short.

According to some embodiments, a method for the efficient disintegration of particles from a decrease of particle mechanical strength includes aerodynamically heating the gaseous carrier to a temperature range of polymer transition from the glass state to a state of high elasticity.

According to some embodiments, the particles are treated in an apparatus including:

a cylindrical housing that has on its inner surface projections that project radially inward and have sharp edges with a length that does not exceed the length of fibrous PTFE particles obtained in the abrasive treatment;

a polymer grinding unit rotatingly and coaxially installed in the cylindrical housing and having a tapered rotating abrasive tool with a layer of hard crystals, such as diamond crystals intended for abrasive treatment of hard PTFE blocks, the polymer grinding unit supporting a hollow cylindrical cage that carries a plurality of particle-disintegrating elements that project from both sides of the cage, the particle-disintegrating elements having sharp edges with dimensions not exceeding the fibrous length of the PTFE particle; and the polymer grinding unit and hollow cylindrical cage having common axes of rotation; and a cylindrical aerodynamic rotor that is concentrically arranged inside the hollow cylindrical cage on said common axis of rotation and that forms an annular gap with the cage, the cylindrical aerodynamic rotor comprising a hub, a plurality of axially spaced parallel disks arranged perpendicular to the axis of rotation supported by the hub, and a plurality of blades secured in the disks, arranged in radial outward direction from the peripheries of said disks toward the hollow cylindrical cage, the blades having sharp edges, the length of which does not exceed the length of fibrous particles. The cage and the aerodynamic rotor rotate in mutually opposite directions.

Thus, interaction of the gas-particle mixture with the aforementioned blades, projections, and particle-disintegrating elements generates areas of intense turbulences or vortexes when during the above-described process the cylindrical cage and the aerodynamic rotor rotate in mutually opposite directions with appropriate rotation speeds, and the fibrous PTFE particles enter the spaces between the blades and the particle-disintegrating elements, as well as between the particle-disintegrating elements and the inward radial projections of the housing.

The sharp edges of the blades and particle-disintegrating elements both have lengths not exceeding the length of the fibrous particles that facilitate formation of microvortexes.

The gas-particle mixture acquires a high frequency of rotation during rotation of the rotor and cylindrical cage. The gas-particle-mixture transfers from the aerodynamic rotor rotating with a certain linear speed defined by the radius of the rotor, to the microvortexes that rotate with a speed that is defined by radiuses of the microvortexes. When the aforementioned microvortexes collide with the fibrous PTFE particles, these particles experience the effect of high destruction forces comparable to cavitation.

As any dielectric polymer, PTFE is polarized when it develops mechanical stress. A polarized polymer is thermodynamically imbalanced and has an unstable state. On the other hand, heating of polarized PTFE leads to its rapid irreversible depolarization.

According to some embodiments, a method for cooling in a pulsating temperature-alternating field is provided by the supply of liquid nitrogen into the zone of aerodynamic disintegration. Liquid nitrogen instantly expands when it sharply converts from a liquid state to a gaseous state, and this leads to cooling of the gas-particle mixture.

Liquid nitrogen is periodically injected into the disintegration zone with a time interval not greater than:

$$\tau=\alpha F_{sa}\Delta t/Q \quad (3)$$

where:

$\tau$ is time interval $\alpha$ is coefficient of heat transfer $F_{sa}$ is surface area of PTFE particles $\Delta t$ is difference of temperatures prior and after heating Q is amount of heat transferred to PTFE particles In the aerodynamic disintegration zone the particles rotate together with the aerodynamic rotor. Those particles that have a greater mass are thrown by centrifugal forces in the outward radial direction, and the process of their disintegration is continued. According to some embodiments, the central area of the aerodynamic disintegration zone may be connected to a vacuum system providing a suction force. The particles of smaller size, e.g., of submicron size, develop a lower centrifugal force than the large-mass particles since they have a mass insufficient for developing a centrifugal force capable to overcome this suction force. As a result, high-mass particles enter the zone of aerodynamic disintegration on the periphery of the aerodynamic disintegration zone. Smaller particles, e.g., submicron particles, are suctioned into the central channel and are unloaded from the system as a final product.

Figure 2:
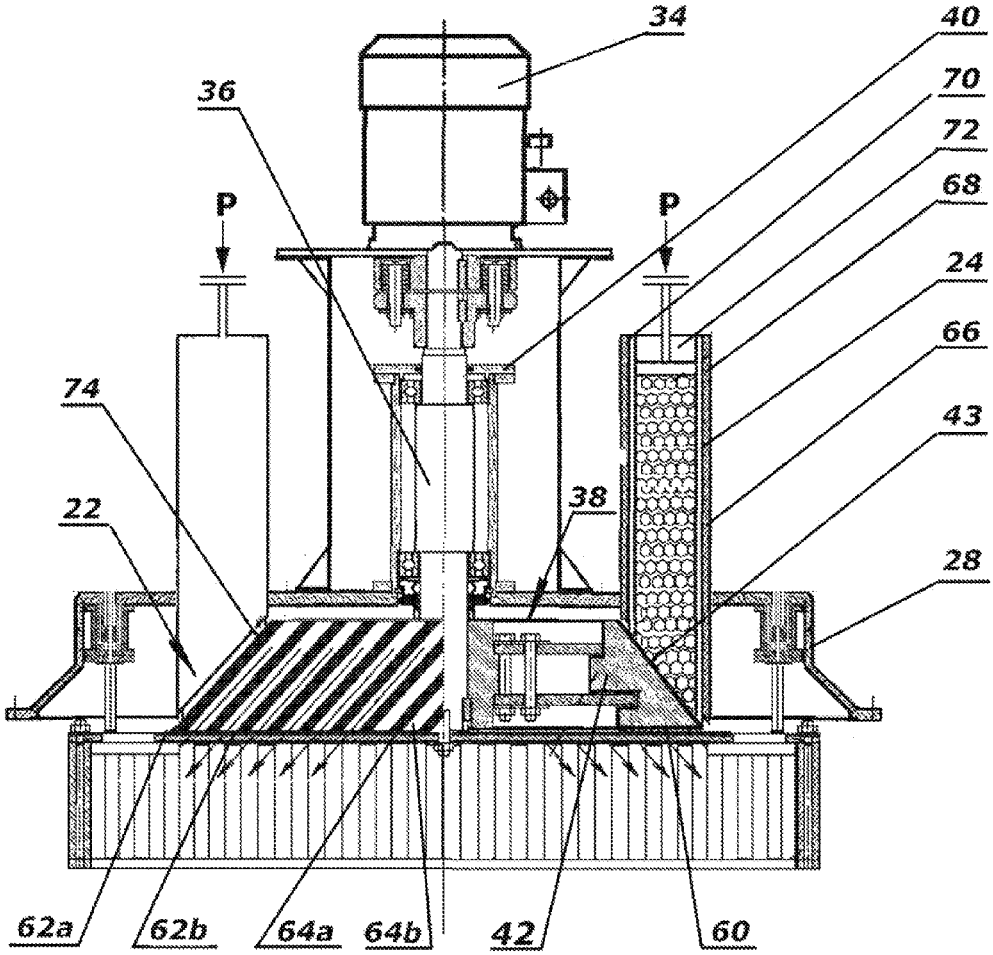
FIG. 2 is a vertical cross-sectional view of the abrasive rotor unit of the apparatus shown in FIG. 1, according to some embodiments.
Figure 3A:
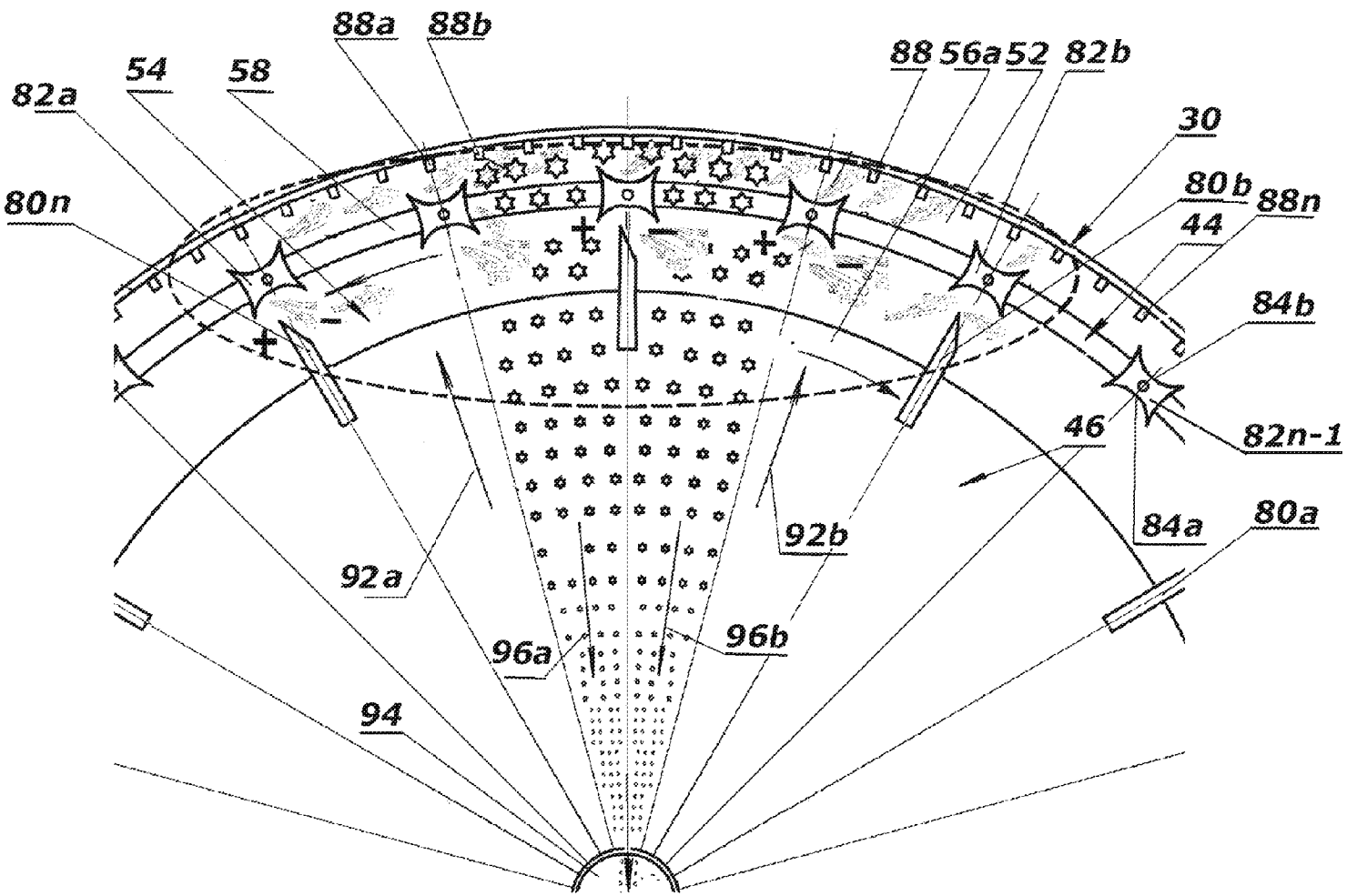
FIG. 3A is a partial view of a cross-section along line III-III in FIG. 1, according to some embodiments.
Figure 3B:
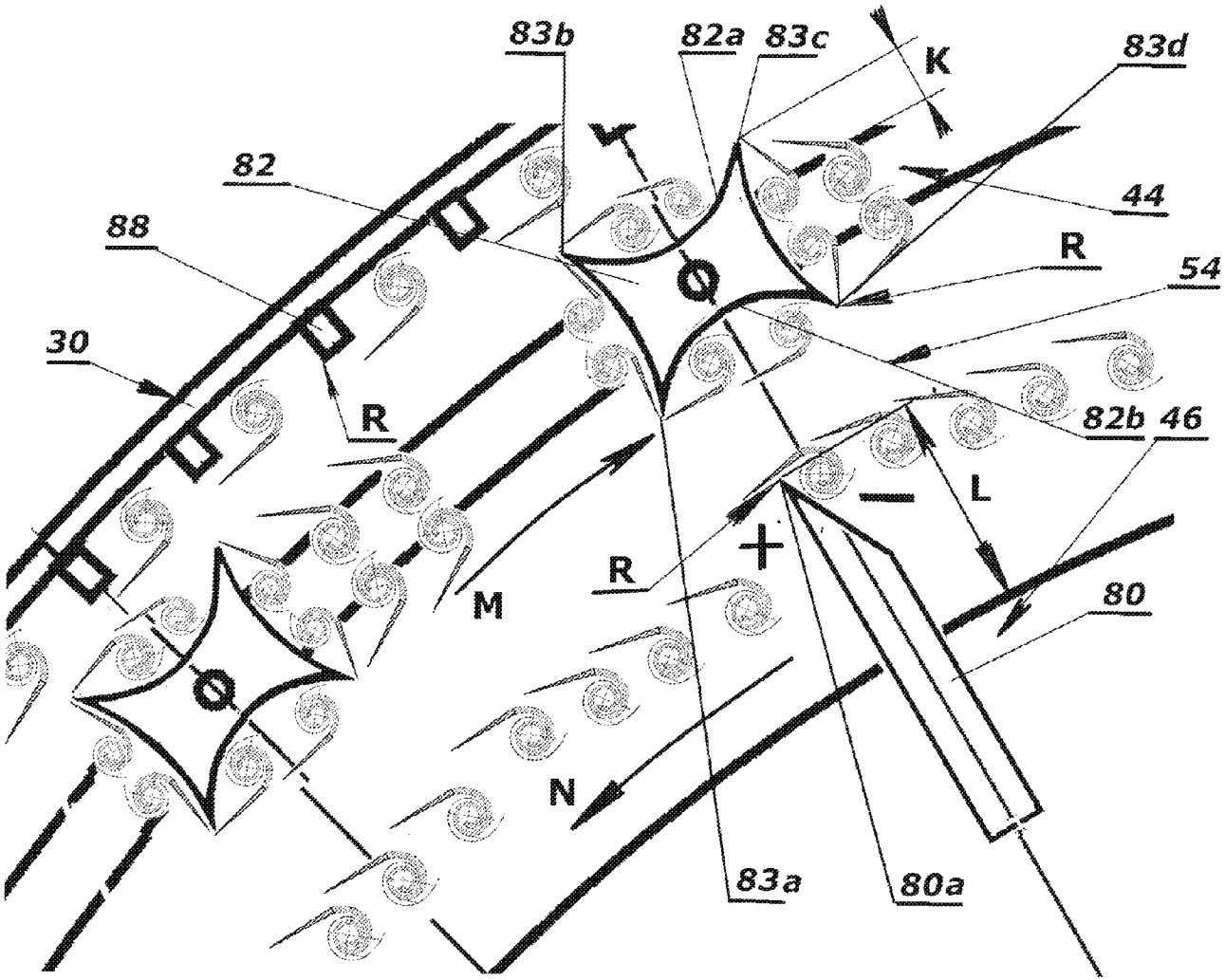
FIG. 3B is an enlarged view of part of an aerodynamic particle-disintegration zone of the apparatus in FIG. 1, according to some embodiments.
Figure 4:
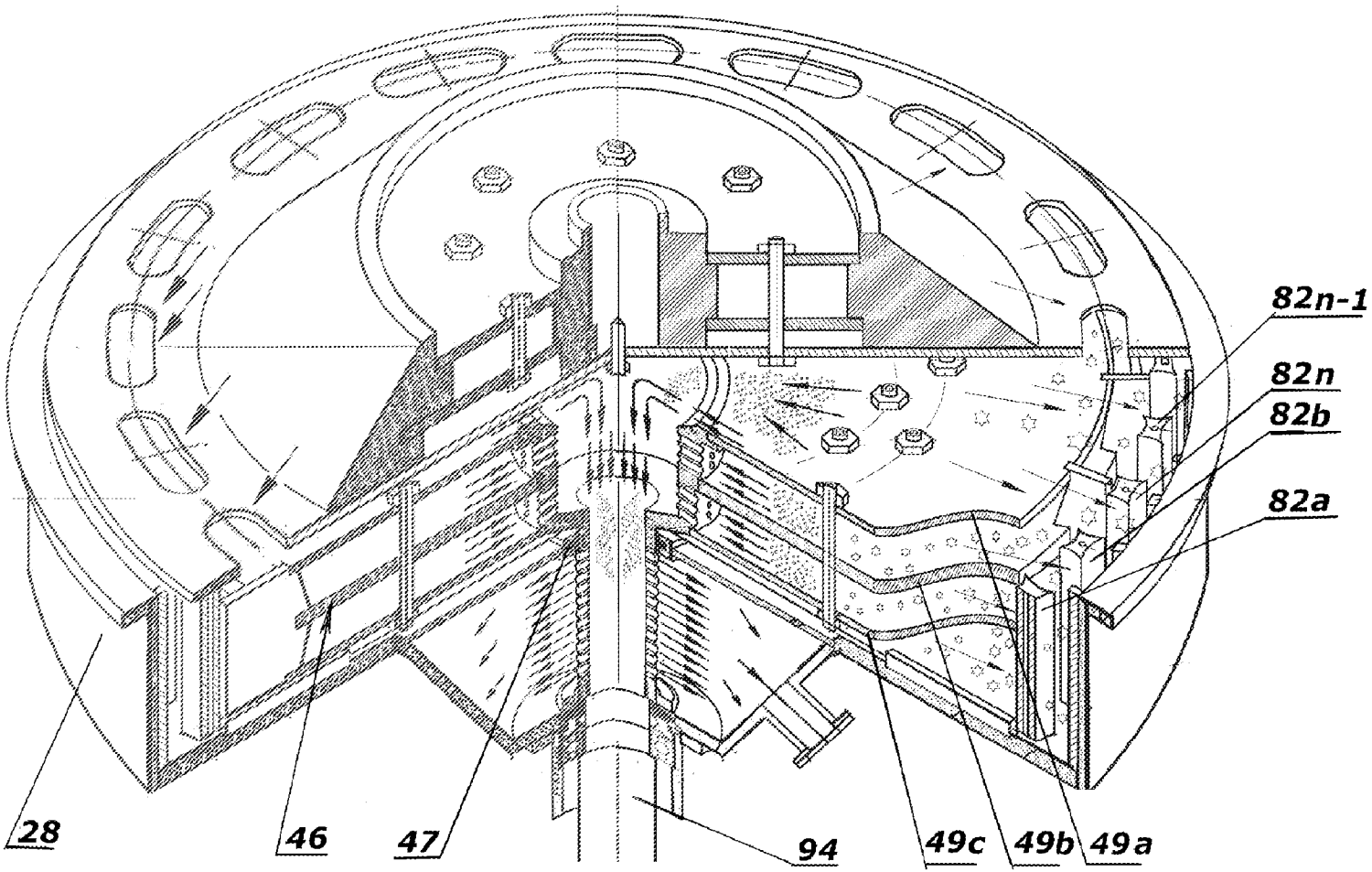
FIG. 4 is three-dimensional view of the upper part of the apparatus with a portion cut out for illustration of inner parts, according to some embodiments.
Figure 5:
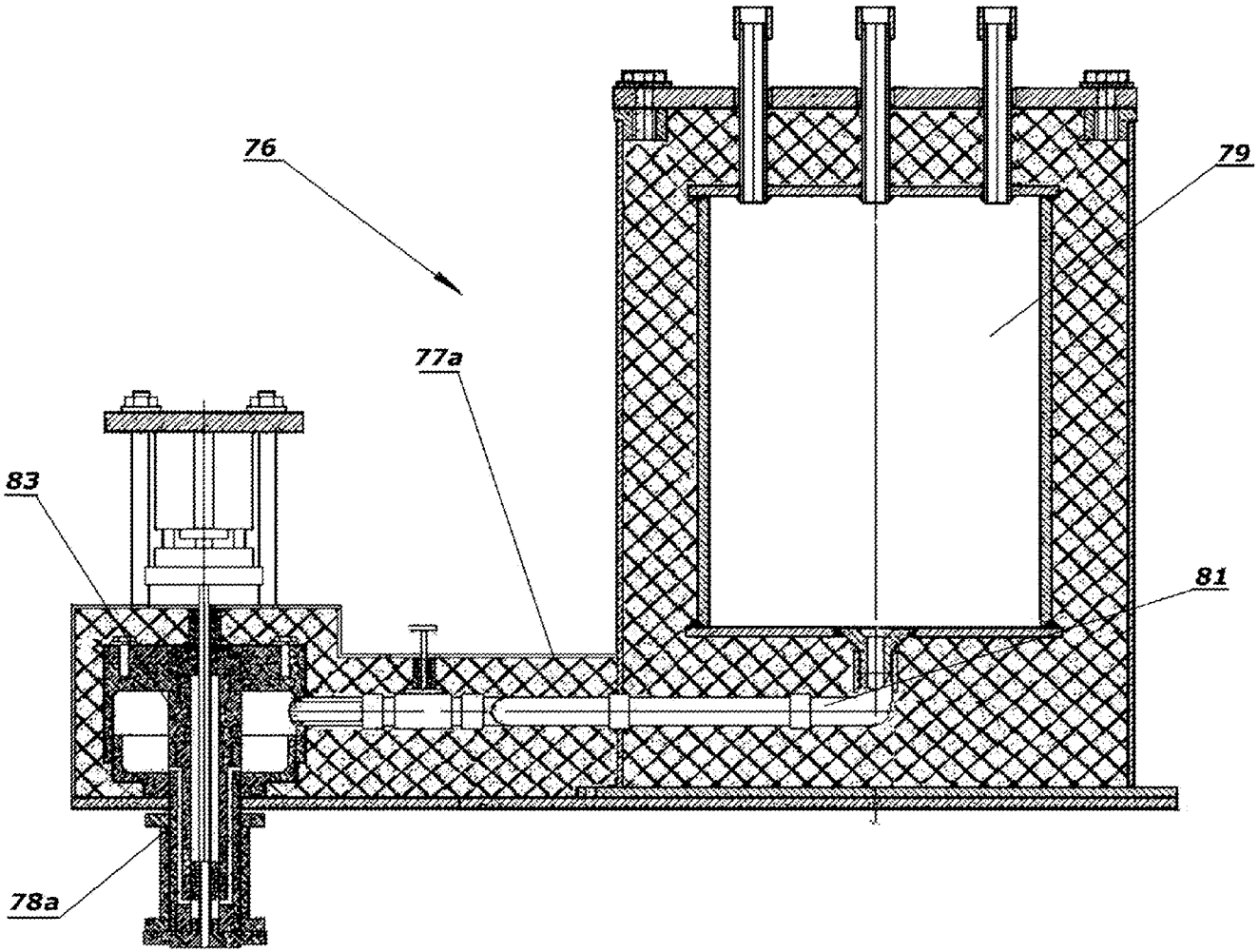
FIG. 5 is a cross-sectional view of one of the cooling systems of the apparatus in FIG. 1, according to some embodiments.

The apparatus for carrying out the method of the invention comprises a rotary-turbulent device shown in FIGS. 1 and 2, wherein FIG. 1 is a vertical sectional view of the apparatus, and FIG. 2 is a vertical sectional view of grinding unit 22. FIG. 3A is a fragmental view of a cross-section along line III-III in FIG. 1. FIG. 3B is an enlarged view of part of an aerodynamic particle-disintegration zone of the apparatus in FIG. 1. FIG. 4 is a three-dimensional view of the upper part of the apparatus with a portion cut out for illustration of inner parts. FIG. 5 is a sectional view of one of the cooling systems of the apparatus shown in FIG. 1.

According to some embodiments of an apparatus for manufacturing submicron polymer powders, designated by reference numeral 20, may include two coaxially arranged units having common axes of rotation. A first unit may be a block-type polymer grinding unit 22 where the solid blocks 24 of polymer are ground for the formation of fibrous polymer particles or particle agglomerates. A second unit may be an aerodynamic unit 26 coaxially arranged underneath grinding unit 22 to receive the polymer fibrous particles and particle agglomerates for disintegration of fibrous particles to submicron size. Unit 26 also imparts a substantially spherical shape to the submicron particles by subjecting them to aerodynamic disintegration and sign-alternating temperature conditions in a gaseous carrier, as described above.

In some embodiments, block-type polymer grinding unit 22 is supported by upper half-housing 28 that is supported by lower half-housing 30. Housing 30 may be installed on frame 32. On its top side, upper half-housing 28 supports first drive motor 34 (shown in FIG. 1). Output shaft 36 of first drive motor 34 supports abrasive tool unit 38 that is rotationally installed inside upper half-housing 28 on bearing unit 40 (FIG. 2). Abrasive rotor 38 comprises tapered abrasive disk 42 arranged in upper half-housing 28 and hollow cylindrical cage 44 (FIG. 1), located below abrasive disk 42 in lower half-housing 30.

In some embodiments, abrasive disk 42 may include grinding surface 43 with abrasive crystals provided with sharp edges having a height comparable to the length of carbon-carbon bonds of the polymer molecules. Grinding surface 43 is arranged at an angle not exceeding 45° to the direction of the force P (FIGS. 1 and 2) uniformly pressing the polymer to the abrasive tool.

Located inside hollow cylindrical cage 44 of abrasive rotor unit 38 is aerodynamic rotor 46 (FIG. 4) having its own drive (FIG. 1) by motor 48, installed in frame 32. Motor 48 supports aerodynamic rotor 46 inside cage 44 of abrasive rotor unit 38 on bearings 50.

As shown in FIG. 3A, which is a fragmental view of a cross-section along line III-III in FIG. 1, lower half-housing 30, hollow cylindrical cage 44 of abrasive rotor unit 38, and aerodynamic rotor 46 are arranged concentrically relative to each other. This creates annular spaces 54 between lower half-housing 30 and hollow cylindrical cage 44. Particle aerodynamic disintegration zone 54 is also formed between hollow cylindrical cage 44 and aerodynamic rotor 46.

As shown in FIG. 3A, aerodynamic rotor 46 has a plurality of first openings circumferentially arranged between blades 56*a*, 56*b*, etc., and hollow cylindrical cage 44 may include a plurality of second openings circumferentially arranged between particle-disintegrating elements 58*a*, 58*b*, etc.

Abrasive rotor unit 38 has tapered abrasive disk 42 provided with substrate 60 having a trapezoidal shape, shown in the vertical cross section in FIG. 2. The tapered surface of substrate 60 is coated with abrasive stripes 62*a*, 62*b*, etc., arranged at an angle of 45° in the vertical cross section in FIG. 2. The abrasive stripes are formed by abrasive crystals, preferably by diamond crystals having sharp edges. The taper angle of the abrasive disk 42 has a central angle that is no less than 90°. The depth of grooves 64*a*, 64*b*, etc. (FIG. 2), formed between the abrasive crystals should not exceed the size of the fibrous particles obtained in the grinding process. Grooves 64*a*, 64*b*, etc. are intended for discharging the fibrous particles formed at the grinding stage directly into aerodynamic unit 26.

Located above the tapered abrasive surface of abrasive disk 42 is a polymer-loading unit, such as feeder 66 (FIGS. 1 and 2). Feeder 66 may include an assembly of two concentric cylindrical bodies 68 and 70. Annular space 72 between cylindrical bodies 68 and 70 may be filled with solid block-like polymer bodies 24, e.g., of PTFE, intended for grinding in block-type polymer-grinding unit 22 of the apparatus.

Polymer bodies 24 are pressed to the surface of the abrasive disk by a force P, uniformly pressing the polymer to the abrasive tool during abrasive grinding. In FIGS. 1 and 4 the polymer-pressing device is shown in the form of pistons.

For uniformity of pressure with which the PTFE blocks are pressed to the abrasive surface, the pressure member may be made in the form of a pressure ring fitted into the space 72 (FIG. 2).

In order to optimize efficiency of grinding PTFE blocks 24 and to provide an optimal gap between the feeder 66 and the abrasive surface of abrasive disk 42, the output area of feeder 66 is provided with replaceable sealing element 74. Sealing 74 may be made from a polymer, e.g., PTFE, and is maintained in contact with the tapered abrasive surface of disk 42. Wear of sealing element 74 occurs at the initial stage of operation of the apparatus and may not exceed the thickness of the abrasive layer (FIG. 2), according to some embodiments.

According to some embodiments, apparatus 20 may include a cooling system supplying liquid nitrogen to the zone of contact of PTFE with the abrasive surface. As mentioned above, liquid nitrogen is periodically injected into the aforementioned zone with a time interval not exceeding $\tau=\alpha F_{sa}\Delta t/Q$, where $\tau$, $\alpha$, $F_{sa}$, $\Delta t$, and Q are defined above (cf. Eq. (3)).

The fibrous PTFE particles are removed from the zone of abrasive grinding and are transferred to the particle aerodynamic disintegration zone, i.e., to space 54 (FIG. 3A). The transfer occurs by means of centrifugal and aerodynamic forces created during rotation of abrasive rotor 42. These particles are cooled by liquid nitrogen to −196° C. Particles cyclically cooled by liquid nitrogen to −196° C. acquire internal defects (microcracks) that promote particle disintegration.

Pulsed sign-alternating cooling of the particles is carried out with the use of cooling system 76 (FIGS. 1 and 5). According to some embodiments, cooling system 76 is assembled from several units (only two of which, i.e., units 77*a* and 77*b*, are shown in FIG. 1). Dispensing devices (only two of which, i.e., dispensing devices 78*a* and 78*b* are shown in FIG. 1) are installed in the upper housing 22 and are arranged as closely as possible to zone 54 of aerodynamic disintegration. Each block also contains a crio-vessel, such as crio-vessel 79, a crio-line, such as crio-line 81, and a control valve, such as control valve 83 (FIG. 5). All working elements of the cooling system are provided with thermal insulation, such as thermal insulation 85 (FIG. 5). Thermal insulation 85 maintains the outer surfaces of the thermal elements sufficiently warm in spite of the superlow temperature (−196° C.) inside the cooling system. The valves and dispensers are controlled from a CPU (not shown) that controls operation of the valves and dispensers for injection of metered doses of liquid nitrogen with given time intervals based on the temperature-control principle. The liquid nitrogen dose is calculated by a formula that is experimentally proven.

As shown in FIG. 4, cylindrical aerodynamic rotor 46 is concentrically arranged inside hollow cylindrical cage 44 on a common axis of rotation. Rotor 46 forms an annular gap with the cage, and may include a hub and a plurality of axially spaced parallel disks, such as disks 49*a*, 49*b*, and 49*c*, arranged perpendicular to the axis of rotation X-X (FIG. 1). The disks are supported by hub 47 (FIG. 4) and are provided with a plurality of blades 80*a* through 80*n* (FIG. 3A). Blades 80*a* through 80*n* are secured in the disks, arranged in radial outward direction from the peripheries of the disks toward the hollow cylindrical cage 44. Blades 80*a* through 80*n* have sharp edges, such as sharp edge 80*a* shown in FIG. 3B. The length L of sharp edge 80*a* may not exceed the length of fibrous particles (not shown). Cage 44 and aerodynamic rotor 46 rotate in mutually opposite directions shown by arrows M and N in FIG. 3B. The blades are equally spaced from each other in the circumferential direction of the aerodynamic rotor 46.

According to some embodiments hollow cylindrical cage 44 may include particle-disintegrating elements 82*a*, 82*b*, . . . 82*n*−1, 82*n* (FIGS. 3A and 3B). Elements 82*a*, 82*b*, 82*n* may be rigidly fixed in the body of hollow cage 44 and are equally spaced from each other in the circumferential direction of hollow cage 44. Although the particle-disintegrating elements may have different geometries, it is preferable to make these elements in the form of tetragonal inserts (FIG. 3B), having two concave sides, such as sides 82*a* and 82*b* (FIG. 3B). Concave sides 82*a* and 82*b* may be projected from both sides from the cylindrical body of the hollow cage 44 so that corners of the tetragon form sharp projections 83*a*, 83*b*, 83*c*, and 83*d* (FIG. 3B). The dimension K of these projections may not exceed the dimensions of fibrous particles, according to some embodiments. It is understood that such particle-disintegrating elements are shown only for illustrative purposes and that the particle-disintegrating elements can be made in any other form, e.g., as sharp pins projecting from both sides of cylindrical hollow cage 44. Furthermore, the inner surface of lower housing 30 of apparatus 20 may include on its inner surface radial projections 88*a* through 88*n* protruding inward toward the facing particle-disintegrating elements 82*a* through 82*n*.

Blades 80*a* through 80*n*, particle-disintegrating elements 82*a*, 82*b* . . . 82*n*, and projections 88*a*, 88*b* . . . 88*n* of lower housing 30 are arranged in the areas of aerodynamic particle disintegration. Their number is selected with reference to radii on the inner surface of lower housing 30, on the inner and outer surfaces of hollow cylindrical cage 44, and on the outlet surface of aerodynamic rotor 46. Hollow cylindrical cage 44 and aerodynamic rotor 46 form two bodies that have vortex-generation members and rotate in mutually opposite directions. The ratios of the aforementioned radii and the number of the blades, elements, and projections are selected so that their interaction with the gas-particle mixture in the aerodynamic zone generates turbulence. The turbulence facilitates and accelerates disintegration of the fibrous particles under effect of vortex forces and collisions of particles with each other and with the aforementioned blades, elements, and projections. More specifically, the number of particle-disintegrating elements is selected from generation of discrete compressions and expansions of the gas-particle mixture with a frequency not less than 20,000 per second.

As shown in FIG. 1, zone 54 of aerodynamic disintegration may be connected to a submicron-particle separation unit including aspiration system 90 and a series of cyclone-type separators 91*a*, 91*b*, and 91*c*. Particles are thus separated from the gas flow and collected for unloading to a receiving container (not shown). Aspiration system 90 suctions air from the environment the air flow is used as a carrier gas for subsequent mixture with polymer particles.

In aerodynamic disintegration zone 54, the particles rotate together with aerodynamic rotor 46 (FIG. 3A). Those particles that have a greater mass are thrown by centrifugal force in the outward radial direction shown by arrows 92*a*, 92*b*, . . . etc., and the process of their disintegration is continued. The central area of the aerodynamic disintegration zone is connected to vacuum system 90. Particles of smaller size, develop a lower centrifugal force than large-mass particles, and therefore cannot overcome the central force of vacuum attraction. As a result, a classification process occurs according to which high-mass particles enter the zone of aerodynamic disintegration on the periphery of the aerodynamic disintegration zone. Meanwhile, smaller particles are transferred to the central channel 94 in the direction shown by arrows 96*a*, 96*b* and are unloaded from the system as a final product.

According to some embodiments, apparatus 20 operates as follows. A charge of solid polymer bodies 24 is loaded into the polymer feeder 66 to contact the tapered surface of abrasive disk 42 (FIGS. 1 and 2). Disk 42 and hollow cylindrical cage 44, are brought into rotation with drive motor 34. Aerodynamic rotor 46 is also brought into rotation with drive motor 48, the charge of the polymer feeder is pressed to the tapered surface of the abrasive disk 42, aspiration system 90 and pulsating cooling system 76 are activated, and the polymer particle-disintegrating process is initiated.

According to some embodiments, in the first stage the solid polymer bodies are abrasively disintegrated by abrasive disk 42 into relatively large fibrous particles or particle agglomerates having dimensions not exceeding 20×20×200 μm. In this stage of treatment, the particles are not only reduced in size but also are reduced in molecular weight, and their physical and mechanical properties change as well.

The treatment may be carried out at a linear speed of the abrasive disk 42 in the range of 30 to 40 m/sec. The linear speed of the abrasive disk may determine the size of the particles. The abrasive wear destroys PTFE molecules, reduces the molecular mass of the PTFE particles, and decreases the softening and melting points of PTFE. The force of pressure from the PTFE blocks on the abrasive surface is maintained constant during the entire grinding process.

The fibrous PTEF particles obtained in the grinding stage are softened as a result of aerodynamic heating of the gaseous carrier caused by boundary-layer friction of the gaseous carrier on the surface of rotating bodies of the particle-disintegrating apparatus, as well as by friction between the molecules of gas and the particles. The heated gas-particle mixture is cooled to −196° C. by periodically supplying liquid nitrogen from cooling system 76 to the zone of contact of the PTFE bodies 24 with the abrasive disk 42. The particles are moved from the zone of abrasive wear to the second stage of treatment for further disintegration of fibrous particles in aerodynamic disintegration zone 54 (FIG. 3A). All working elements of cooling system 76, such as valves and dispensers, are controlled from a CPU (not shown), which controls operation of the valves and dispensers for injection of metered doses of liquid nitrogen with given time intervals based on the temperature-control principle. The liquid nitrogen dose is calculated by a formula that is experimentally proven.

In a second stage, the obtained fibrous particles and particle agglomerates are subjected to aerodynamic heating along with the gaseous carrier. Particle agglomearates are also subject to turbulent aerodynamic disintegration under the effect of aerodynamic forces of two turbulent counterflows pulsating with a frequency greater than 20000 Hz, as well as under effect of vortex movement of the particle-gas mixture. At the same time, the PTFE particles obtained in the aerodynamic block are subjected to a pulsating sign-alternating temperature field caused by the supply of liquid nitrogen from the pulsed cooling system 76 for optimization of particle shape due to stimulation of relaxation processes of the particles and decrease in polarization.

According to some embodiments, in the aerodynamic stage of the process the gas-particle mixture is subjected to cyclic heating and cooling in temperature ranges that provide melting of the low-molecular phase of the PTFE particles and evaporation of liquid nitrogen that was supplied to the mixture in the disintegration stage of the solid-phase PTFE. At the same time, the particles are softened and depolarized, whereby they acquire a more optimized and smoothened shape, which is substantially spherical. According to some embodiments, efficiency of particle disintegration is achieved by aerodynamically heating the gaseous carrier to a temperature of polymer transition from a glass state to a state of high elasticity.

In aerodynamic disintegration zone 54, the particles rotate together with aerodynamic rotor 46 (FIG. 3A). Flat blades 80*a* through 80*n*, particle-disintegrating elements 82*a*, 82*b* . . . 82*n*, and radial inner projections 88*a*, 88*b* . . . 88*n* of the housing, arranged at an angle of 90° relative to the vectors of rotation of gaseous flows, sharply change directions of passing-by flows. Braking of flows in front of the aforementioned projections and elements, compression of flows near the edges of these obstacles, rarefaction behind the obstacles and, hence, formation of vortexes that fill the entire area behind these projections and elements, generate a turbulent mode of the gas-mixture flow.

At high-speed rotation of the rotating elements, positions and dimensions of the vortexes constantly change over time. Then, the vortexes separate and gradually attenuate, while their energy is spent on heating the gas-particle mixture. Since the particles are very small in size, their heating occurs during small fractions of a second. Furthermore, particle disintegration intensifies by collision with each other and with the aforementioned obstacles.

Those particles that have a greater mass are thrown by centrifugal forces acting in the outward radial direction, and the process of their disintegration is continued. However, the central area of aerodynamic disintegration zone 54 is connected to aspiration system 76. Particles of a smaller size, e.g., of submicron size, develop a lower centrifugal force than the large-mass particles, and therefore cannot overcome the central force of vacuum attraction. As a result, a classification process occurs according to which high-mass particles enter aerodynamic disintegration zone 54 on its periphery, while smaller particles, e.g., submicron particles, are transferred into central channel 94 and unloaded from the system as a final product. Thus, according to some embodiments, apparatus 20 creates a closed-loop system of disintegration and classification that provides circulation of the particles being treated, adjusting the size of the obtained submicron particles.

The invention claimed is:

1. A method for manufacturing a submicron polymer powder comprising the following steps:

providing an apparatus comprising a polymer grinding unit having a rotating abrasive tool; an aerodynamic disintegration zone formed between two bodies that have vortex generation members and rotate in mutually opposite directions; and a cooling system;

providing a polymer charge selected from solid polymer blocks and a coarse polymer powder;

subjecting the polymer charge to abrasive grinding in the polymer grinding unit to obtain fibrous particles and particle aggregates;

forming a gas-particle mixture by mixing the fibrous particles and particle aggregates with a carrying gas and transferring the gas-particle mixture to the aerodynamic disintegration zone;

placing the gas-particle mixture in the aerodynamic disintegration zone into a space formed between the two bodies that have vortex generation members and rotate in mutually opposite directions;

disintegrating the fibrous particles and particle aggregates in the aerodynamic disintegration zone by causing collisions of fibrous particles and particle aggregates with said vortex generation members and simultaneously subjecting the fibrous particles to the effect of vortexes, centrifugal forces, and suction forces acting in a direction opposite to the centrifugal forces, as well as to a pulsating sign-alternating temperature field generated by said cooling system, and to pulsating aerodynamic forces generated by the vortex generation members and cause alternating compression and expansion of the carrying gas;

separating submicron particles by mass from the gas-particle mixture by means of the submicron-particle separation unit; and removing the separate particles from the apparatus.

2. The method according to claim 1, further providing a force uniformly pressing the polymer charge to a rotating abrasive tool during the abrasive grinding.

3. The method according to claim 2, wherein the rotating abrasive tool has a grinding surface with abrasive crystals provided with sharp edges that have a height comparable to carbon-carbon bonds of polymer molecules.

4. The method according to claim 3, wherein the polymer grinding is carried out with a linear speed not less than 30 m/sec.

5. The method according to claim 4, wherein the rotating abrasive tool comprises a grinding surface arranged at an angle not exceeding 45° to the direction of the force uniformly pressing the polymer to the abrasive tool.

6. The method of claim 5, wherein the polymer is polytetrafluoroethylene.

7. The method according to claim 3, wherein the fibrous particles and particle aggregates are softened by aerodynamically heating the carrying gas, the softening caused by boundary-layer friction of the gaseous carrier, fibrous particles, and particle aggregates on the surface of the vortex generation members.

8. The method of claim 7, wherein at the stage of subjecting the fibrous particles to the effect of a pulsating sign-alternating temperature field, the particles are cooled with the use of liquid nitrogen to the temperature of −196° C.

9. The method of claim 8, wherein alternating compression and expansion of the carrying gas is carried out at a frequency not less than 20,000 Hz.

10. The method of claim 9, wherein the step of separating submicron particles by mass from the gas-particle mixture is carried out by developing a suction force at said submicron-particle separation unit, said suction force providing suction of particles that have a mass insufficient for developing a centrifugal force capable to overcome this suction force.

11. The method of claim 10, wherein the two bodies that have vortex generation members and rotate in mutually opposite directions generate oppositely directed turbulent flows that have relative linear velocity not less than 200 m/sec.

12. The method of claim 9, wherein the two bodies that have vortex generation members and rotate in mutually opposite directions comprise an aerodynamic rotor and a hollow cylindrical cage, said vortex generation members comprising blades secured in aerodynamic rotor and particle-disintegrating elements secured in the hollow cylindrical cage, the linear speed of grinding not less than 30 m/sec being provided by selecting a ratio between the outer radius of the rotating abrasive tool and the inner radius of the outer radius of the aerodynamic rotor, and wherein said frequency of at least 20,000 Hz is provided by a ratio of the number of blades in the aerodynamic rotor and the number of particle-disintegrating elements in the hollow cylindrical cage.

13. The method of claim 1, wherein alternating compression and expansion of the carrying gas is carried out at a frequency not less than 20,000 Hz.

14. The method of claim 1, wherein the two bodies that have vortex generation members and rotate in mutually opposite directions generate oppositely directed turbulent flows that have relative linear velocity not less than 200 m/sec.

15. An apparatus for manufacturing a submicron polymer powder comprising the following:

a housing that has an inner surface;

a polymer loading unit for loading a polymer powder charge installed on the housing, the polymer loading unit being provided with a polymer pressing device;

a polymer grinding unit having a rotating abrasive tool to which the polymer powder charge is pressed by the polymer pressing device during operation of the apparatus;

a hollow cylindrical cage rigidly connected to the rotating abrasive tool for joint rotation therewith in a first direction;

an aerodynamic rotor located inside the hollow cylindrical cage that rotates in a second direction opposite to said first direction;

a first drive unit for rotating the rotating abrasive tool and the hollow cylindrical cage in the first direction and a second drive unit for rotating the aerodynamic rotor in the second direction, the hollow cylindrical cage and the aerodynamic rotor forming an annular space into which the polymer is supplied from the polymer grinding unit;

a cooling system with means for pulsed supply of liquid nitrogen to the polymer in the grinding unit and in said annular space; and a submicron-particle separation unit; the housing having projections that project in the radial inward direction from the inner surface, the aerodynamic rotor having radial outward projections that project into said annular space, and the hollow cylindrical cage having particle-disintegrating elements that project in the radial inward direction into said annular space and in the radial outward direction toward the inner surface of the housing.

16. The apparatus of claim 15, wherein the rotating abrasive tool has a grinding surface with abrasive crystals provided with sharp edges that have a height comparable to the length of carbon-carbon bonds of polymer molecules.

17. The apparatus of claim 16, wherein the rotating abrasive tool, the aerodynamic rotor, and the hollow cylindrical cage are arranged coaxially and have a common axis of rotation, the rotating abrasive tool has a tapered shape and an abrasive surface that is located at an angle not exceeding 45° to the common axis of rotation.

18. The apparatus of claim 17, wherein distances between adjacent abrasive crystals do not exceed 20 μm, the rotating abrasive tool having through recesses that pass through the abrasive surface in the direction of a rotating abrasive tool generatrix, the recesses having bottoms and the abrasive crystals having tips, the distance from the bottoms of the recesses to the tips of the abrasive crystals being equal to the size of the fibrous particles and particle agglomerates obtained in the grinding unit.

19. The apparatus of claim 18, wherein the submicron-particle separation unit comprises an aspiration unit that is connected to the center of the hollow cylindrical cage and at least one cyclone-type separator located between the aspiration unit and the center of the hollow cylindrical cage.

20. The apparatus of claim 15, wherein the submicron-particle separation unit comprises an aspiration unit that is connected to the center of the hollow cylindrical cage and at least one cyclone-type separator located between the aspiration unit and the center of the hollow cylindrical cage.

* * * * *